United States Patent [19]

Pahlman et al.

[11] 4,138,465

[45] Feb. 6, 1979

[54] SELECTIVE RECOVERY OF NICKEL, COBALT, MANGANESE FROM SEA NODULES WITH SULFUROUS ACID

[75] Inventors: John E. Pahlman, Bloomington; Sanna E. Khalafalla, Minneapolis, both of Minn.

[73] Assignee: The United States of America as represented by the Secretary of the Interior, Washington, D.C.

[21] Appl. No.: 860,249

[22] Filed: Dec. 13, 1977

[51] Int. Cl.[2] ..... C01G 45/00; C01G 51/00; C01G 53/00

[52] U.S. Cl. ..... 423/49; 423/32; 423/50; 423/150; 423/DIG. 4

[58] Field of Search ..... 423/27, 34, 41, 49, 423/50, 150, DIG. 4

[56] References Cited

U.S. PATENT DOCUMENTS

| | | | |
|---|---|---|---|
| 1,889,021 | 11/1932 | Kobe | 423/50 |
| 3,169,856 | 2/1965 | Mero | 423/150 |
| 3,810,827 | 5/1974 | Kane et al. | 423/DIG. 4 |
| 4,029,733 | 6/1977 | Faugeras et al. | 423/41 |

*Primary Examiner*—Brian Hearn

*Attorney, Agent, or Firm*—William S. Brown; Donald A. Gardiner

[57] ABSTRACT

Nickel, cobalt and manganese are recovered from deep sea nodules by leaching with sulfurous acid. In addition, selective extraction of nickel and cobalt from copper is achieved by suitable adjustment of process variables such as leaching time and volume and concentration of acid.

3 Claims, 2 Drawing Figures

Figure 1:
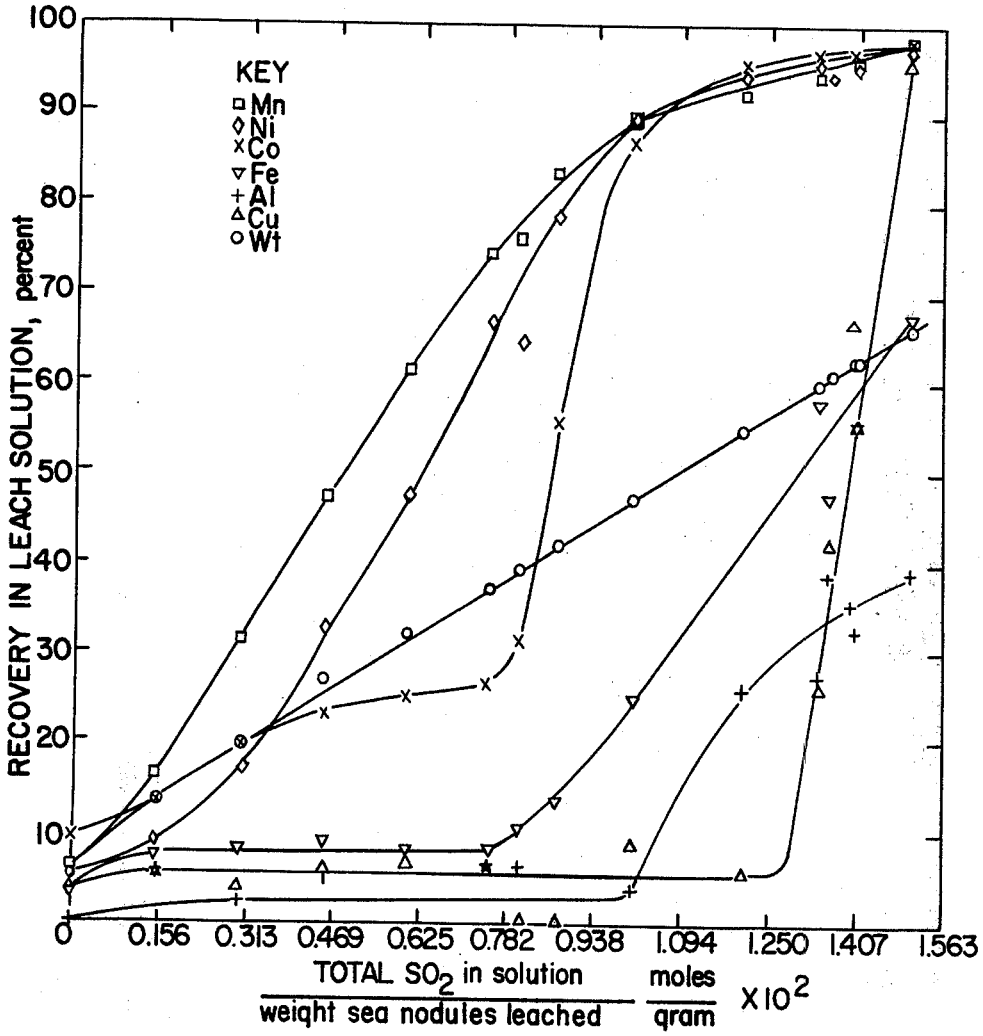

SELECTIVE RECOVERY OF NICKEL, COBALT, MANGANESE FROM SEA NODULES WITH SULFUROUS ACID

Mineral resources of the ocean floor, e.g., deep sea nodules, are abundant but are difficult to mine. To compensate for the high cost of mining, processing of the nodules must involve low-cost techniques. Such nodules typically consist of about 0.16 to 2.0 percent nickel, 0.014 to 2.3 percent cobalt, 8.2 to 41.1 percent manganese, 0.028 to 1.6 percent copper, 2.4 to 26.6 percent iron, 0.8 to 6.9 percent aluminum, with the balance consisting essentially of silica. Prior art methods for processing nodules include smelting in an electric furnace (Canadian Patent No. 871,066), hydrochloric acid leaching (U.S. Pat. No. 3,832,165), sulfuric acid leaching, and ammonia leaching (U.S. Pat. No. 3,788,841). These processes, however, are generally complex, costly, time consuming and involve high energy consumption.

It now has been found, according to the process of the invention, that nickel, cobalt and manganese may be simply, efficiently and rapidly recovered from sea nodules by leaching the nodules with a dilute solution of sulfur dioxide in water at ambient conditions of temperature and pressure. This process enables 90 percent, or greater, solubilization of nickel, cobalt and manganese from the nodules in periods of about 10 minutes or less. Under these leaching conditions, copper and most of the iron and aluminum present in the nodules remain in the solid residue. Thus, in addition to providing a rapid and efficient means for recovery of nickel, cobalt and manganese from the nodules, the process of the invention also provides an effective separation of these metals from copper and from a major portion of the iron and aluminum. This is in contrast to most prior art processes in which copper is leached along with nickel and cobalt, thereby necessitating difficult and costly separation processes.

In addition, the process of the invention has the advantage of recovering manganese from the nodules, in contrast to prior art leaching processes in which manganese is not leached, but remains in the residue and is discarded as tailings. Following leaching according to the process of the invention, manganese is readily separated from the nickel and cobalt by ammonia precipitation.

The essential features of the invention will now be described in detail. The nodules are initially ground to a particle size less than about 100 mesh. It has been found that fine grinding of the nodules is important since the particle size of about 100 mesh represents a threshold size, above which there is an abrupt decrease in the selectivity, sensitivity and rapidity of the leaching process. Grinding of the nodules to a particle size as small as −200 mesh is generally readily accomplished by conventional means since the nodules are very friable.

The finely ground nodules are then treated with a leach solution consisting of dilute sulfurous acid, i.e., a dilute aqueous solution of $SO_2$. Although the optimum concentration of the sulfurous acid may vary with the specific composition and particle size of the ground nodules, a concentration of about 6% to 8% $SO_2$ in water is generally satisfactory. The concentration of the sulfurous acid is, however, not critical since it has been found that the amounts of metals leached is dependent on the total amount of $SO_2$ in the leach solution rather than on the concentration of $SO_2$ in the leach solution.

This is in contrast to conventional mineral acid leaching processes where concentration of the acid is usually critical.

The amount of sulfurous acid employed should be sufficient to provide an amount of $SO_2$ to react with, and thereby solubilize, substantially all of any nickel, cobalt and manganese in the nodule particles, without appreciable reaction with copper contained in the nodules, thereby providing the selectivity that constitutes an essential aspect of the invention. This is possible since for each metal there is a threshold value for the ratio $M_{SO_2}/W_{sn}$, i.e., the ratio of total moles of $SO_2$ in the leach solution to the weight of ground nodules, required for the initiation of reaction between the metal and $SO_2$. Thus, nickel, cobalt and manganese are leached at relatively low values of $M_{SO_2}/W_{sn}$, while copper, iron and aluminum are leached only at much higher values of $M_{SO_2}/W_{sn}$. Optimum values of $M_{SO_2}/W_{sn}$ will again vary with the specific composition and amounts of the nodules, but ratios in the range of about $0.94 \times 10^{-2}$ to $1.25 \times 10^{-2}$ will usually provide substantially complete extraction of nickel, cobalt and manganese without appreciable extraction of copper, and only minor proportions of iron and aluminum.

As discussed above, the process of the invention may be carried out at ambient conditions of temperature and pressure, i.e., at about 25° C. and a pressure of 1 atmosphere, thus providing greatly improved economy and convenience as compared to prior art processes requiring the use of elevated temperature and pressure. In addition, the time required for the leaching process of the invention is much less than that required in most prior art processes. Although the optimum leaching time will also depend on variables such as the type and amount of nodules and state of subdivision of the nodules, a leaching period of as little as ten minutes is usually sufficient to achieve the desired efficiency and selectivity of the leaching process.

By the use of sulfurous acid, according to the process of the invention, material demands on the leaching vessels are also much less severe than those required for the mineral acids employed by prior art processes. The much shorter leaching times and weaker solution acidity permit the use of stainless steel vessels for sulfurous acid leaching, while titanium or other exotic alloys are generally required to withstand corrosion in leaching with mineral acids. In addition, because the leaching of the invention is done at ambient temperature and pressure, glass or glass-lined vessels can be used. The weak acidity of the sulfurous acid leaching solution is also advantageous in any subsequent neutralization step since the demand for alkali or ammonia in the neutralization steps will be much smaller than that required in the case of a mineral acid leach. Any conventional form of leaching vessel, with conventional means for admixing the ground nodules and the leach solution, may be used.

Following reaction of the sulfurous acid leach solution with the ground nodules, the solution is separated from the residue by conventional procedures such as filtration or decantation, and will usually contain about 90 percent, or more, of the nickel, cobalt and manganese in the nodules. Separation of the manganese from the nickel and cobalt is readily achieved by treatment of the leach solution with a combination of ammonia and carbon dioxide to precipitate the manganese as $MnCO_3$, with the nickel and cobalt remaining in solution in the form of their complex hexammines. Separation and recovery of the nickel and cobalt from the manganese-free leach solution may be readily achieved by conventional methods. In one such method, most of the nickel is precipitated directly from the solution as nickel powder by a preferential reduction with $H_2$. The remaining nickel and all the cobalt are precipitated as sulfides with $H_2S$. Cobalt and nickel are recovered from the cobalt and nickel sulfides via either the soluble cobalt ammine process or the nickel preferential reduction process.

In another method recently developed by Burrows, Canadian Pat. No. 1,001,422, an aqueous ammoniacal leach solution containing cobalt and nickel is contacted with a kerosene solution of a bisphenol sulfide extractant. The cobalt-enriched organic phase is separated from the nickel-enriched aqueous phase and stripped with a cobalt sulphate solution containing sulfuric acid.

Recovery of copper from the residue may be accomplished by conventional processes such as leaching with an ammonium carbonate-ammonium hydroxide solution to recover the copper as copper amine carbonate, $[Cu(NH_3)_4]CO_3$.

The process of the invention will be more specifically illustrated by means of the following examples.

EXAMPLE 1

This example illustrates the effect of the amount of $SO_2$ in sulfurous acid leaching solution on extraction of metal values. The tests involved leaching 20 grams of −200 mesh deep sea nodules with 200 ml of sulfurous acid containing various amounts of $SO_2$. The resulting mixtures were filtered after 10 minutes and the residue was washed with distilled water. Analyses of the leach residues were used to determine the solution recoveries. Results are shown graphically in FIG. 1.

It is evident from the data of FIG. 1 that nickel, cobalt and manganese leach at much lower values of $M_{SO_2}/W_{sn}$ than do copper, iron and aluminum, thus providing a basis for the selective extractions of the different metal values according to the invention.

EXAMPLE 2

Figure 2:
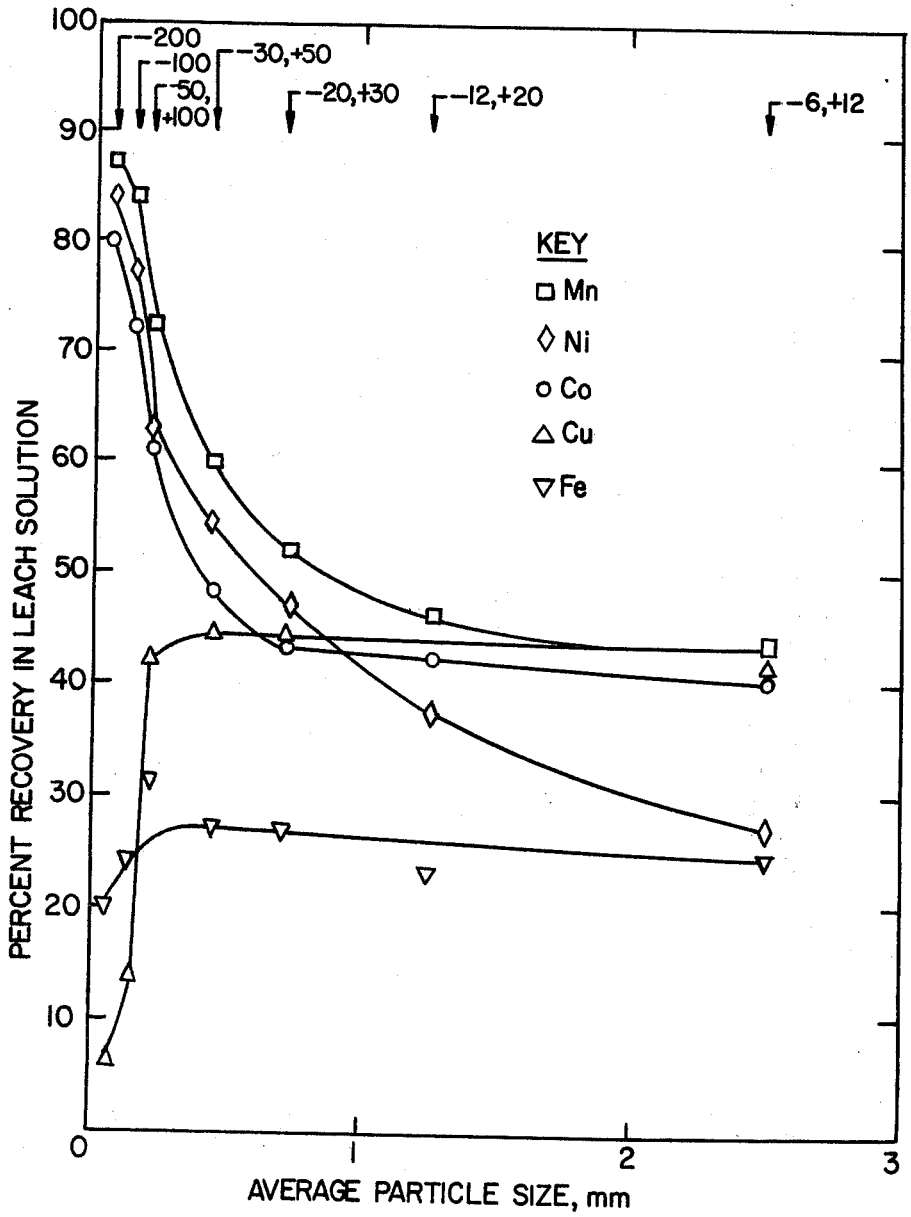

This example illustrates the effect of particle size of the ground nodules on the extraction of metal values by the process of the invention. Twenty grams each of minus 6 plus 12, minus 12 plus 20, minus 20 plus 30, minus 30 plus 50, minus 50 plus 100, minus 100 and minus 200 mesh particles of sea nodules were reacted with 200 ml of sulfurous acid containing 0.184 moles $SO_2$ for 10 minutes. The mixtures were filtered and the residues were washed with distilled water. Analyses of the leach residues and untreated nodules were used to determine the solution recoveries. Results are shown graphically in FIG. 2. It is evident from the data of FIG. 2 that particle sizes as small as −100 mesh, and preferably as small as −200 mesh, are needed to effect sharp demarcations in selectivity that enable separation of particular metal values by means of the process of the invention.

We claim:

1. A process for recovery of metal values from sea nodules comprising nickel, cobalt, manganese, copper, iron and aluminum, said process consisting essentially of reducing the nodules to a particle size of less than about 100 mesh, leaching them with dilute sulfurous acid, the ratio of moles of $SO_2$ in the leach solution to the total weight of the nodules, in grams, being in the range of about $0.94 \times 10^{-2}$ to $1.25 \times 10^{-2}$, whereby nickel, cobalt and manganese are selectively extracted while leaving the major proportion of the copper, iron and aluminum in the residue, and separating the solution from the residue.

2. The process of claim 1 in which the leaching is carried out in a period of about 10 minutes or less.

3. The process of claim 2 in which the leaching is carried out at ambient temperature and pressure.

* * * * *

UNITED STATES PATENT AND TRADEMARK OFFICE

CERTIFICATE OF CORRECTION

PATENT NO. : 4,138,465
DATED : February 6, 1979
INVENTOR(S) : John E. Pahlman and Sanaa E. Khalafalla It is certified that error appears in the above-identified patent and that said Letters Patent are hereby corrected as shown below:

The name of the second listed inventor on the title page of the patent should be --Sanaa E. Khalafalla--.

Signed and Sealed this

*Eighteenth* Day of *May 1982*

[SEAL]

*Attest:*

GERALD J. MOSSINGHOFF

*Attesting Officer*

*Commissioner of Patents and Trademarks*